US006662726B1

(12) United States Patent
Steiner

(10) Patent No.: US 6,662,726 B1
(45) Date of Patent: Dec. 16, 2003

(54) KINETIC ENERGY PENETRATOR

(75) Inventor: Edwin G. Steiner, York, PA (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 0 days.

(21) Appl. No.: 09/520,575

(22) Filed: Mar. 8, 2000

Related U.S. Application Data

(60) Provisional application No. 60/123,380, filed on Mar. 8, 1999.

(51) Int. Cl.[7] ..... F42B 14/06; F42B 12/04

(52) U.S. Cl. ..... 102/521; 102/517; 102/519

(58) Field of Search ..... 102/517–519, 102/521, 523

(56) References Cited

U.S. PATENT DOCUMENTS

| | | | | |
|---|---|---|---|---|
| 4,108,072 A | * | 8/1978 | Trinks et al. | 102/518 |
| 4,123,975 A | * | 11/1978 | Mohaupt | 102/518 |
| 4,635,556 A | | 1/1987 | Boecker et al. | 102/518 |
| 4,671,181 A | | 6/1987 | Romer et al. | 102/518 |
| 4,677,915 A | * | 7/1987 | Boecker et al. | 102/517 |
| 4,697,525 A | | 10/1987 | Böcker et al. | 102/518 |
| 4,708,064 A | | 11/1987 | Bisping et al. | 102/517 |
| 4,770,102 A | | 9/1988 | Bisping et al. | 102/521 |
| 4,779,536 A | * | 10/1988 | Luther et al. | 102/521 |
| 4,867,077 A | | 9/1989 | Marlow et al. | 109/36 |
| 4,872,409 A | | 10/1989 | Becker et al. | 102/517 |
| 4,920,888 A | * | 5/1990 | Luther et al. | 102/518 |
| 4,981,067 A | | 1/1991 | Kingery | 89/36.17 |
| 5,063,855 A | | 11/1991 | Diel et al. | 102/521 |
| 5,088,416 A | | 2/1992 | Sabranski | 102/517 |
| 5,155,295 A | | 10/1992 | Campoli | 102/430 |
| 5,223,667 A | | 6/1993 | Anderson | 102/517 |
| 5,359,938 A | | 11/1994 | Campoli et al. | 102/521 |
| 5,370,034 A | | 12/1994 | Turner et al. | 89/36.02 |
| 5,413,027 A | | 5/1995 | Mixon | 89/36.17 |
| 5,577,432 A | | 11/1996 | Becker et al. | 89/36.17 |
| 5,600,989 A | | 2/1997 | Segal et al. | 72/253.1 |
| 6,363,856 B1 | * | 4/2002 | Stoker, Jr. et al. | 102/516 |

OTHER PUBLICATIONS

*A Review of Penetration Mechanisms and Dynamic Properties of Tungsten and Depleted Uranium Penetrators* by S.P. Andrew, R.D. Caligiuri, and L.E. Eiselstein, *Proceedings of a symposium by the Refractory Metals Committee held at the 120th Annual Meeting of the Minerals, Metals & Materials Society*, New Orleans, Louisiana, 1991.

*High Strain Rate Deformation Behaviors of Kinetic Energy Penetrator Materials During Ballistic Impact*, by Lee S. Magness, Jr., *Mechanics of Materials: An International Journal*, vol. 17, S. Nemat–Nasser Editor–in–Chief; pp. 147–154, 1994.

* cited by examiner

*Primary Examiner*—Harold J. Tudor
(74) *Attorney, Agent, or Firm*—Wiggin & Dana LLP; Gregory S. Rosenblatt

(57) ABSTRACT

A subcaliber kinetic energy penetrator has first and second portions formed of dense material and secured to each other. The first portion, located ahead of the second portion preferably represents between 9% and 15% of the penetrator mass and a similar percentage of the combined lengths of the two portions. The first portion is formed of a material effective to produce a relatively large hole in an explosive reactive armor faceplate. The second portion is preferably formed from material selected to best perforate basal armor.

21 Claims, 9 Drawing Sheets

KINETIC ENERGY PENETRATOR

CROSS-REFERENCE TO RELATED APPLICATION

Benefit is claimed of U.S. Provisional Patent Application Ser. No. 60/123,380, filed Mar. 8, 1999 and entitled "Kinetic Energy Penetrator".

BACKGROUND OF THE INVENTION

1. Field of the Invention

This invention relates to kinetic energy projectiles, and more particularly to kinetic energy projectiles for defeating reactive armor.

2. Description of the Related Art

There exists an ongoing evolution of both the armor used on armored vehicles (e.g., tanks and armored personnel carriers (APC's)) and the projectiles used to defeat such armor.

Common anti-armor projectiles of the type fired by tank guns and artillery are typically divided into high explosive and kinetic energy subgroups. High explosive anti-tank (HEAT) projectiles typically include one or more shaped explosive charges which, upon detonation in close proximity to the armor, cause a concentrated jet to penetrate the armor. Common kinetic energy projectiles make use of a long rod penetrator to punch a hole through the armor. As implied by its name, the long rod penetrator includes an elongate, dense, heavy penetrator body or core having a relatively small cross-section. Upon impact with the armor, this small cross-section provides a concentration of impact force on the armor effective to penetrate the armor. Long rod penetrators are typically utilized in armor-piercing fin-stabilized discarding sabot (APFSDS) ammunition.

To defeat modern anti-tank projectiles, explosive reactive armor (ERA), also known as reactive armor (RA) and reactive explosive armor (REA), has been developed. Various ERA forms are disclosed in U.S. Pat. Nos. 4,867,077, 5,577,432, 5,413,027, 5,370,034, and 4,981,067, the disclosures of which are incorporated herein by reference in their entireties. Most ERA is modular, with individual modules formed as "boxes" which are typically rectangular prisms but may be otherwise formed. Each ERA box typically includes: an outer layer or plate ("face plate") of steel, facing generally outward from the vehicle; a layer of explosive inboard thereof; and an additional layer or plate ("rear plate") of steel inboard of the explosive. The ERA boxes are arrayed over the surface of the vehicle to be protected and may be directly in contact with the basal armor of the vehicle or may be held slightly spaced-apart from the basal armor.

When a rod penetrator impacts ERA, contact between the penetrator and the outer plate produces a shockwave which detonates the explosive layer. The explosion drives the outer plate further outward. Where the outer surface of the outer plate is not normal to the impact trajectory of the projectile, contact between the outer plate and the projectile produces a deflecting force on the projectile, deflecting both its orientation (defined by its longitudinal axis) and its subsequent trajectory (defined by the path of its center of mass) away from normal to the basal armor. Initially, the impact may bend the penetrator proximate its fore end. The penetrator will typically penetrate the outer plate producing a hole therein. Such penetration does not end the interaction between the outer plate and the projectile. A side of the penetrator will remain in contact with a side of the hole in the outer plate as the penetrator continues inward toward the vehicle and the plate continues outward. The result is a continued deflective force on the penetrator normal to its impact trajectory.

If applicable, a rear plate of the ERA may be driven backward (toward the basal armor) by the explosion. This further enhances deflection since the movement of the rear plate will have a component normal to the impact trajectory. Thus, upon penetration of the face plate and engagement with the rear plate, this relative movement will continuously expose new material on the rear plate to the already deflected penetrator fore end. This further deflects the projectile and provides a potentially greater dissipation of projectile kinetic energy than if the rear plate were simply affixed flat against the basal armor. When the penetrator finally reaches the basal armor, its trajectory has been deflected further off normal to the basal armor and its tip bent yet further off normal so that the projectile is more likely to deflect off the basal armor or attack such a large area of the basal armor that the penetrator will not cause penetration of the basal armor.

BRIEF SUMMARY OF THE INVENTION

Accordingly, in one aspect the invention is directed to an ammunition system featuring a subcaliber kinetic energy penetrator having first and second portions. The first portion preferably represents between about 9% and about 15% of the penetrator mass while the second portion is heavier, is positioned aft of the first portion, and is frangibly coupled thereto. The first portion is preferably tungsten-based while the second portion is preferably uranium-based. The former is chosen to produce a relatively wide hole in the face plate of explosive reactive armor while the latter is chosen to best perforate basal armor. The connection between the two portions is configured to rupture under pre-determined conditions, namely at a threshold torque between the first and second sections. Such rupture reduces the tendency of interaction forces between the armor and the first portion from deflecting the second portion into an ineffective, highly oblique relation to the basal armor.

An exemplary second section length is between 400% and 700% of the first section length.

The penetrators of the invention may be utilized with a variety of known sabot structures including push and pull type sabots. In a push-type sabot, propellant gases are substantially trapped behind a sealing flange or other protuberance located relatively aft along the projectile and typically aft of an additional flange. In a pull-type sabot, the sealing flange is relatively forward along the projectile and may be ahead of an additional flange or feature which helps maintain the projectile centered within the tube. Exemplary push-type sabots are disclosed in U.S. Pat. Nos. 5,155,295 and 5,359,938 while an exemplary pull-type sabot is disclosed in U.S. Pat. No. 5,063,855. The disclosures of these patents are incorporated herein by reference in their entireties. The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
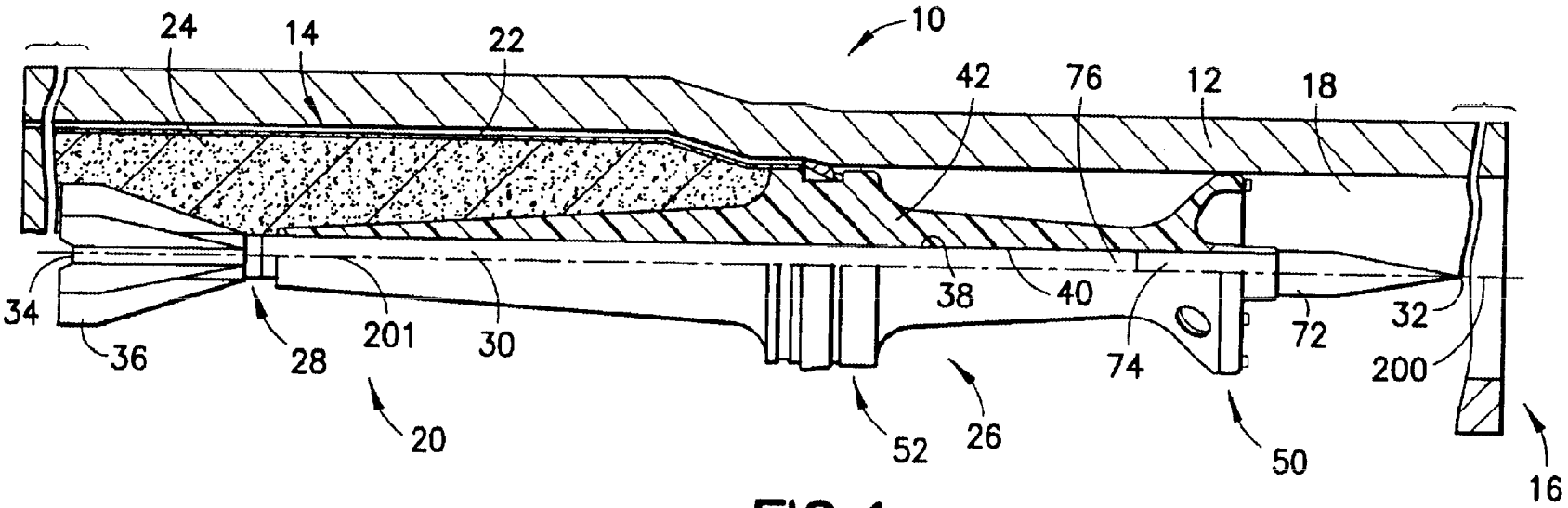
FIG. 1 is a cross-sectional view of a projectile according to principles of the invention chambered in a weapon.

FIG. 1 shows a weapon 10 having a tube 12 extending from a chamber 14 at the aft end of the tube to a muzzle 16 formed by a fore end of the tube. The tube extends along a central longitudinal axis 200 and may have a smooth bore or inner surface 18 with a diameter D of an exemplary 120 mm which is characteristic for the main gun of a modern NATO main battle tank (e.g., the U.S. M1-A2).

An ammunition round 20 is provided having a case 22 accommodated within the chamber 14. The case extends from a base to a mouth and is substantially filled with a propellant 24. A saboted projectile 26 is accommodated within the mouth of the case 22, an aft portion extending into the case 22 and a fore portion extending into the tube 12. The projectile, shown as a long rod penetrator 28, includes a body 30. The projectile and penetrator have a common central longitudinal axis 201 which, while the projectile is in the weapon, is coincident with the axis 200.

The body 30 extends from a fore end 32 to an aft end 34 and bears a plurality of (for example, six) fins 36 extending generally radially outward proximate the aft end 34. Centrally along the body 30, the penetrator bears interlocking features 38 engageable with mating interlocking features 40 of the sabot 42 (shown as an exemplary push-type sabot). The features 38 and 40 may be formed as screw-like threads or as annular thread-like grooves/protrusions engaged with each other so as to be effective to prevent relative longitudinal movement of the penetrator and sabot body.

The sabot 42 has a body formed in an exemplary three segments or petals. The three petals are identical to each other which facilitates a balanced sabot and smooth discard of the sabot. The petals are separated from each other along three planar interfaces at 120 degree angles about the penetrator axis 201. The assembled sabot body fully encircles a major portion of the penetrator body. The sabot body includes fore and aft protuberances 50 and 52 dimensioned to cooperate with the bore 18 so as to maintain the projectile substantially centered along the tube axis 201. In the exemplary embodiment, the petals, and thus the sabot body, are primarily formed of a composite material. Suitable composite materials include carbon and/or aramid fiber in an epoxy or other resinous matrix.

Figure 2:
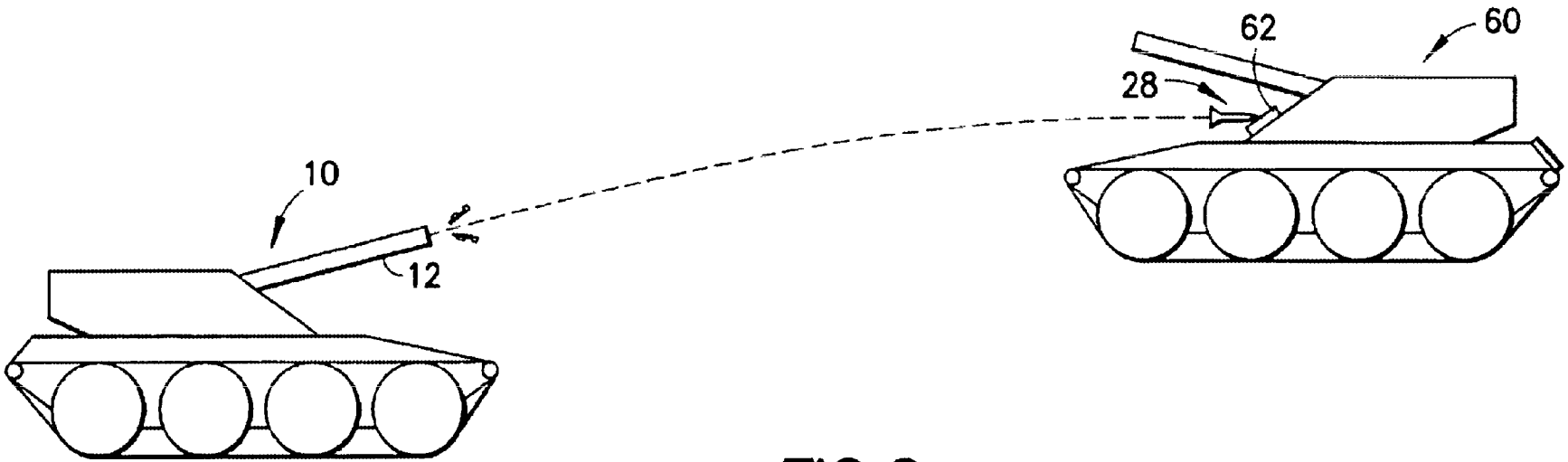
FIG. 2 is a diagrammatic view of a flight path of the projectile of FIG. 1.

The fore protuberance 50 is formed as an annular scoop. The aft protuberance 52 is longitudinally broader than the fore protuberance or scoop 50, forming a bulkhead which largely retains propellant gases behind it and provides the principal positioning of the saboted projectile along the tube axis 200. From the scoop 50 to the bulkhead 52, the sabot body increases in diameter which then decreases or tapers from the bulkhead to the aft end of the sabot. Ignition of the propellant increases the pressure within the case 22, propelling the saboted projectile forward along the axis 200 through the tube. An exemplary muzzle velocity is from about 1,375 to about 1,650 meters per second (m/s). Upon exit from the muzzle, the sabot petals peel off and discard from the penetrator 28. The penetrator 28 then proceeds along its flight path 202 to the target vehicle 60 (FIG. 2). Exemplary impact velocities are from about 1,000 m/s to nearly the muzzle velocity.

Figure 3:
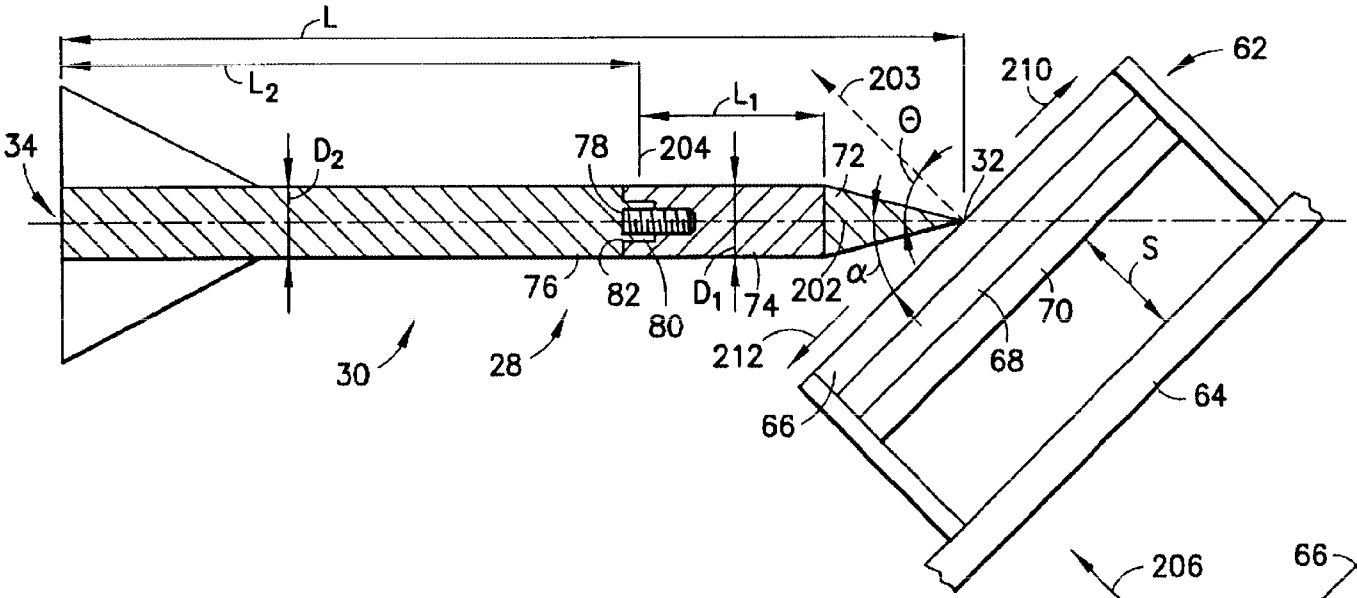
FIG. 3 is a cross-sectional view of a penetrator of the projectile of FIG. 1.
Figure 4:
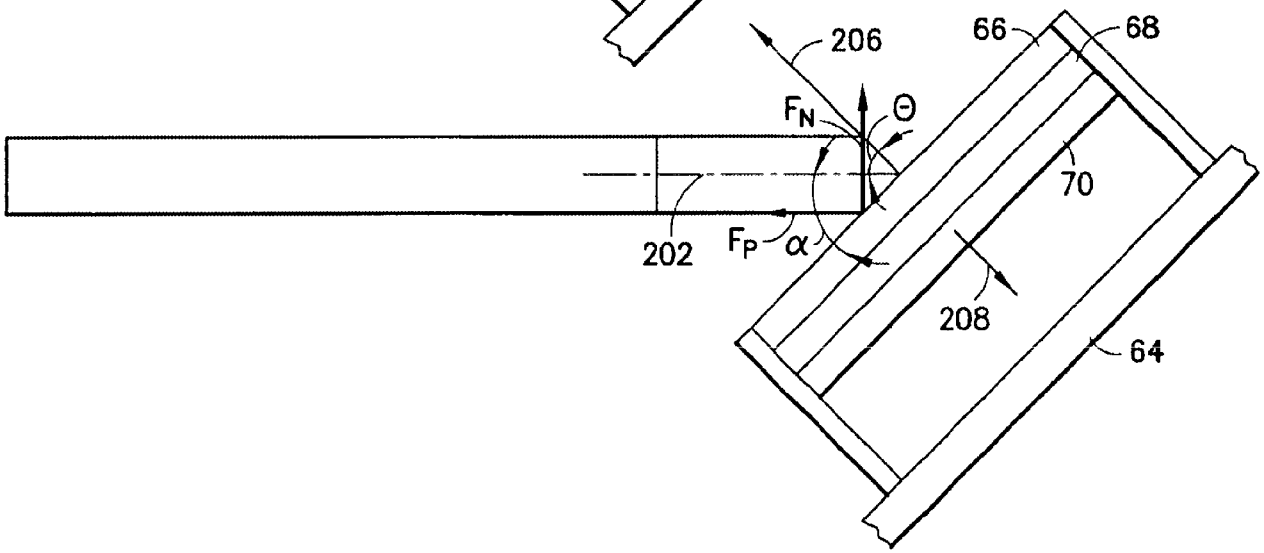
FIGS. 4–8 are semi-schematic views showing stages of interaction between the penetrator of FIG. 3 and vehicle armor.
Figure 5:
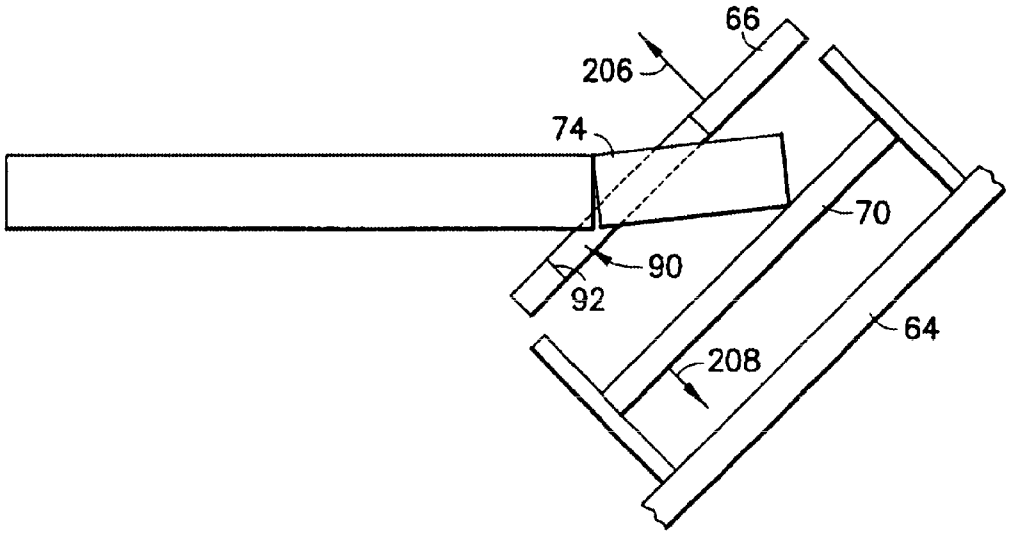

FIG. 3 shows details of the long rod penetrator 28 and the ERA box 62. The ERA box is mounted atop the vehicle basal armor 64. Shown in simplified form, the ERA box includes a sandwich of an outboard steel face plate 66, an explosive layer 68 and an inboard rear plate 70. The inboard surface of the rear plate 70 is held spaced apart from the outboard surface of the basal armor by a separation S. In the illustrated situation, the exemplary flight path 202 is somewhat oblique to the basal armor in the vicinity of impact. If such a flight path is anticipated by the designers of the ERA box, the orientation of the reactive armor sandwich parallel to the basal armor is common. Where the anticipated flight path is more normal to the basal armor, the sandwich may, however, be set at an angle to the basal armor to better deflect the incoming penetrator. Thus, in the illustrated example, the basal armor 64 and base plate 66 share a common outward directed normal 203. At the point of impact, an angle $\theta$ separates the flight path 202 from the normal 203 and its complement $\alpha$ separates the flight path 202 from the plane of the face plate 66. The flight path 202 and normal 203 define opposite upslope and downslope directions 210 and 212 along the face plate 66. The upslope and downslope directions are coplanar with the flight path 202 and normal 203. The upslope direction has a component parallel to the at-impact trajectory and the downslope direction has a component antiparallel to such trajectory.

The body 30 of the penetrator 28 has a length L from the fore end 32 to the aft end 34. Extending aft from the fore end 32 there may be an aerodynamic ballistic tip or nose 72. The nose 72 may have a conical, ogival, or other drag-reducing surface profile. The nose 72 may be formed of composite material, aluminum, or other lightweight material which has a relatively small effect on projectile penetration. Aft of the nose 72 is a first penetrator section 74 formed of an ultradense material such as uranium (depleted), tungsten, tungsten or uranium-based alloys, and tungsten or uranium-based composites. Aft of the first penetrator section 74 is a second penetrator section 76, also formed of an ultradense material. In the exemplary embodiment, the first and second penetrator sections are frangibly coupled to each other via a combination of interfitting features and a threaded stud 78. The interfitting features include a reduced diameter portion 80 of the second penetrator 76 adjacent the fore end thereof and a matching cylindrical bore or pocket 82 formed in the aft end of the first penetrator section 74 and receiving the reduced diameter portion 80. The threaded stud 78 extends centrally and longitudinally from within the reduced diameter portion 80 through the base of the cylindrical bore 82 and into the first penetrator section 74. In the exemplary embodiment, the first penetrator section 74 has a characteristic length $L_1$ and the second penetrator section 76 has a characteristic length $L_2$, such lengths being measured relative to an average separation plane 204 bisecting the interfitting features securing the two sections together. The first and second penetrator sections 74 and 76 further have respective characteristic diameters $D_1$ and $D_2$. In the exemplary embodiment, the first and second penetrator sections are largely cylindrical so that $D_1$ and $D_2$ are the median and modal diameters of the respective sections and are substantially equal to the average diameters of the respective sections (ignoring the relatively small local variations due to the interlocking features 38).

In the exemplary embodiment, the initial impact of the penetrator with the face plate 66 will substantially crush a relatively non-robust nose 72. For simplicity of illustration, the nose 72 has therefore been removed from the following figures. FIGS. 4–8 show a simplified sequence of stages of the interaction between the penetrator and the vehicle armor. Contact/engagement between the fore end of the first penetrator section 74 and the face plate 66 produces an inwardly directed shockwave within the reactive armor sandwich, initiating explosion of the explosive layer 68. Such explosion drives the exemplary face plate 66 outward (206) and drives the rear plate 70 inward (208) toward the basal armor 64. The outward direction is coincident with the local outward-directed normal 203 to the basal armor. The angle θ separates the at-impact flight path or trajectory of the projectile from the outward direction 206. Interaction between the face plate 66 and the first penetrator section 74 produces a force on the first penetrator section having a component $F_P$ antiparallel to the impact trajectory and a component $F_N$ normal to the impact trajectory. The presence of the component $F_N$ tends to deflect the trajectory of the penetrator away from the at-impact trajectory and to an even more oblique relation with the basal armor. Furthermore, the force $F_N$ produces a torque on the penetrator which will tend to rotate the penetrator axis 201 out of alignment with its trajectory or flight path 202 and to yet a more oblique relation to the basal armor. With a conventional rod penetrator, both of these effects will decrease the likelihood of achieving perforation of the basal armor. With the two-section penetrator however, the interaction between the first penetrator section 74 and the face plate 66 can initiate rupture of the frangible coupling between the first and second sections, isolating deflection to the first section. This will reduce the amount by which the second penetrator section 76 is deflected as compared with a conventional monolithic penetrator. Furthermore, deformation is advantageously confined to the first penetrator section 74 and, if such section is made relatively highly deformable, such as if made from a tungsten alloy, a further reduction in the deflection of the second penetrator section may occur as tungsten produces a relatively large hole.

The combination of the kinetic energy of the long rod penetrator and the energy imparted to the face plate by the explosion of the explosive layer produces a hole 90 (FIG. 5) in the face plate having a perimeter 92. The hole 90 will typically be larger than the cross-sectional area of the penetrator body, even when such hole is projected along the longitudinal axis of the penetrator. Advantageously, there is subsequently an interval during which the penetrator is not in contact with the face plate 66. During this interval (the "clearance interval"), the face plate proceeds outward while the penetrator proceeds along its flight path toward the vehicle basal armor. At some point during this interval, the first penetrator section 74 or, more particularly, the portion thereof remaining after ablation caused by perforation of the face plate, will come into contact with the rear plate 70 as the latter moves inward.

Figure 6:
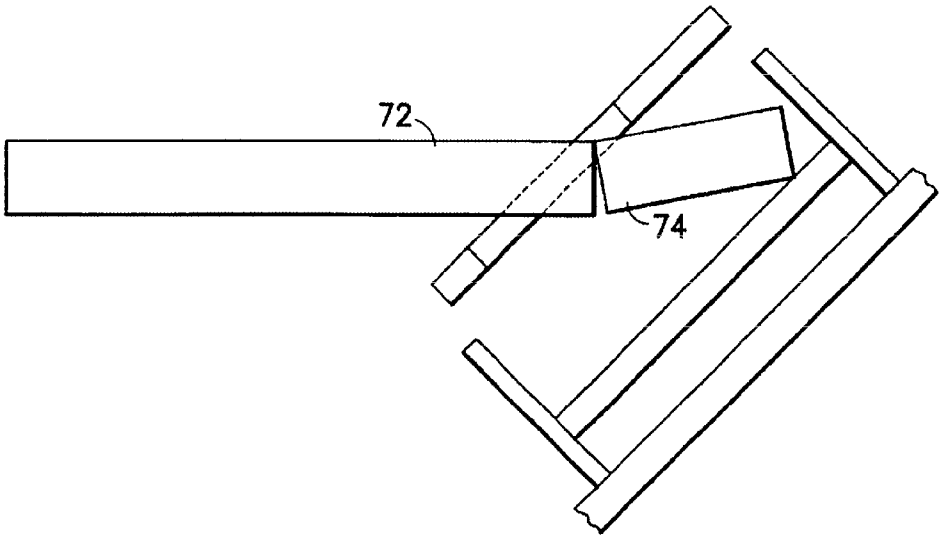

During an interval wherein the long rod penetrator is engaged to the inward moving rear plate ("rear plate engagement interval"), as there is a component of the rear plate's velocity which is parallel (rather than antiparallel) to the trajectory of the penetrator, there will be a tendency for the first penetrator section 74 (or portions thereof) to slide along the rear plate thus exposing a large amount of the rear plate's outboard surface to the penetrator. During this rear plate engagement interval, the component of the engagement force between the rear plate and the penetrator normal to the penetrator trajectory is not passed between the first penetrator section 74 and second penetrator section 76 due to the rupturing of the frangible coupling between the two sections. Thus, during this rear plate engagement interval, the force will continue to deflect the first section 74 relative to the second section 76 (FIG. 6). The rear plate engagement interval may last beyond the end of the clearance interval. Thus, during this rear plate engagement interval, the second penetrator section 76 is further spared deflection forces which would otherwise deflect a monolithic penetrator.

Figure 7:
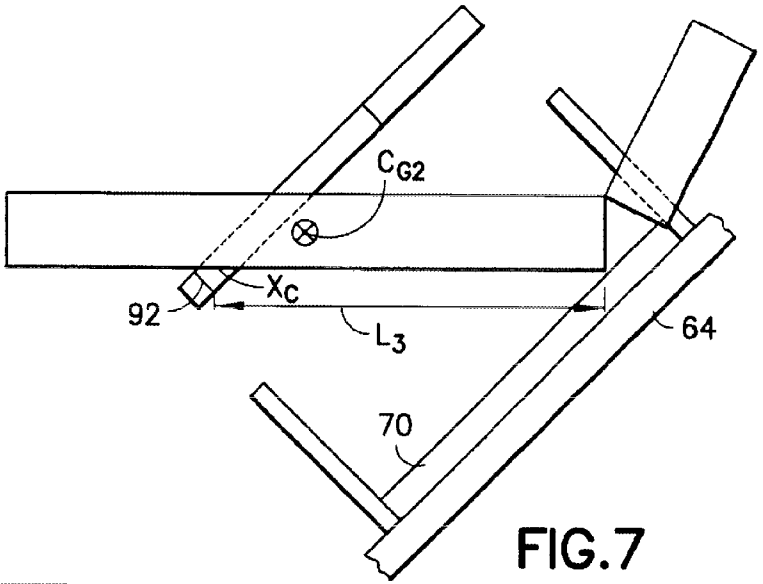
Figure 8:
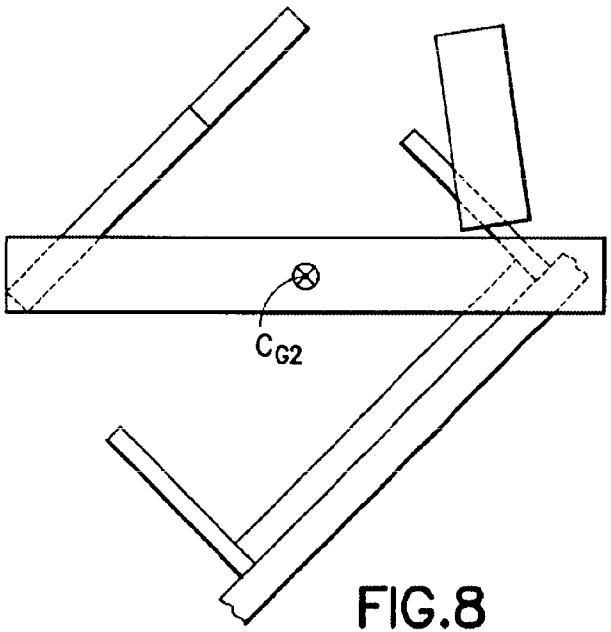

The clearance interval ends when the penetrator comes into contact with the perimeter 92 of the hole 90. This occurs at a location $X_C$ on the penetrator which, advantageously, falls along the second penetrator section 76 at a distance $L_3$ aft of the separation plane 204 (FIG. 7). After this point, the side of the penetrator (or more particularly, the side of the second penetrator section 76) will be in sliding contact with the perimeter 92 at the downslope side thereof. The sliding engagement continues to slow the penetrator, wearing away the face plate and enlarging the hole and also wearing material off the side of the penetrator. The engagement further continues to deflect the penetrator trajectory into a more oblique relationship to the basal armor. This "hole engagement interval" extends until either the projectile has passed through the face plate or the hole 90 has been enlarged so that the hole reaches the boundary of the lateral periphery of the face plate (FIG. 8). If/when the location of engagement between the plate and second penetrator section is ahead of the center of gravity $C_{G2}$ of the second section, the engagement will further deflect the axis of the second section into a more oblique relationship with the basal armor. However, once the point of engagement is aft of the center of gravity, the engagement will deflect the axis (but not the trajectory) back toward normal to the basal armor.

Eventually, the second section 76 impacts the surviving portion of the rear plate 70 and the basal armor 64 (FIG. 7). As the deformation and severance of the first section 74 has spared the second section 76 from much of the deflection which would otherwise be produced by the ERA, the second section advantageously has sufficient remaining kinetic energy and remains at a trajectory effective to perforate the basal armor 64. Especially on a tank, the basal armor is still quite formidable. Thus the second section 76 should represent the majority of the total projectile mass and should retain a majority of the total projectile kinetic energy. With a monolithic projectile, it is estimated that the major bending and fracture produced by the action of the ERA extends along a region of about the forwardmost 10% to 14% of the penetrator (absent the ballistic tip or nose). Thus, selection of the length $L_1$ to represent about 14% of the combined length should leave the second section 76 sufficiently undamaged. With a substantially constant penetrator diameter and with the first and second sections formed of similarly dense materials, the first section would represent a corresponding 14% of the combined penetrator mass while the second section represents substantially the remaining 86% (the nose and fins representing a very small portion).

Such an amount should be effective to defeat the basal armor. More broadly, the first section may represent about 9% to about 15% of the combined penetrator mass with the second section representing substantially the remainder. A broadly preferred range for combined penetrator mass is from about 4.0 to about 4.6 kg. For a 120 mm NATO APFSDS round, an exemplary combined penetrator mass is about 4.5 kg.

To the extent that the size of the initial hole in the face plate is maximized, the deflection of the trajectory of the second piece 76 is minimized. This results from the extension of the duration of clearance interval provided by the larger hole. There may be a number of ways to achieve this. One way is to select the adiabatic shear properties of the respective first and second sections 74 and 76 to respectively provide a maximum size hole in the face plate and a maximum penetration depth in the basal armor. By way of example, tungsten and depleted uranium are two materials of nearly the same density (19.35 g/cm$^3$ and 19.05 g/cm$^3$, respectively) Typical tungsten and uranium-based materials used in penetrators have densities lower than the pure materials, typically, however, in excess of 17.0 g/cm$^3$. The adiabatic shear properties of tungsten relative to uranium are such that with identical mass and cross-sectional area projectiles, a tungsten projectile will produce a larger diameter hole in a given armor plate through which both projectiles are capable of passing, while a uranium projectile will penetrate plates at thicknesses which the tungsten projectile can not penetrate. When an exemplary tungsten penetrator impacts with rolled homogenous armor (RHA) its leading end experiences a mushrooming deformation producing a relatively large yet shallow hole. In distinction thereto a depleted uranium penetrator interacts with the armor more like a chisel, without the same mushrooming deformation, producing a deeper yet narrower hole. Accordingly, tungsten-based materials may be preferred for the first penetrator section 74 while uranium-based materials are preferred for the second penetrator section 76.

Figure 9:
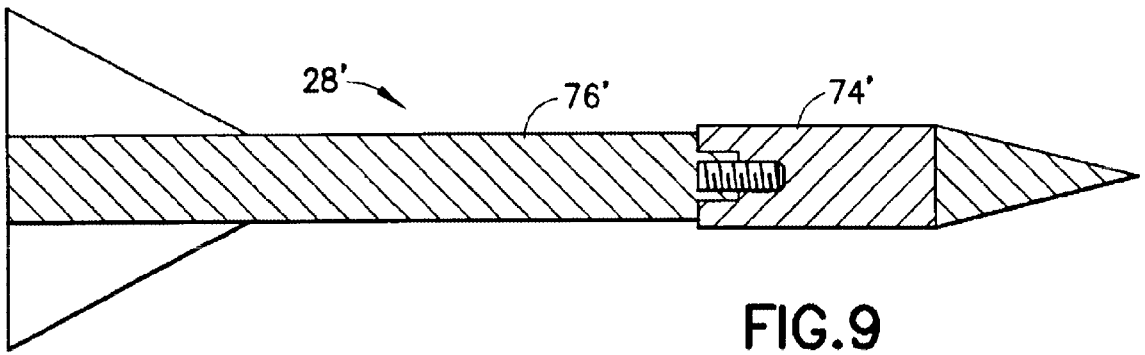
FIG. 9 is a cross-sectional view of a first alternate penetrator.
Figure 10:
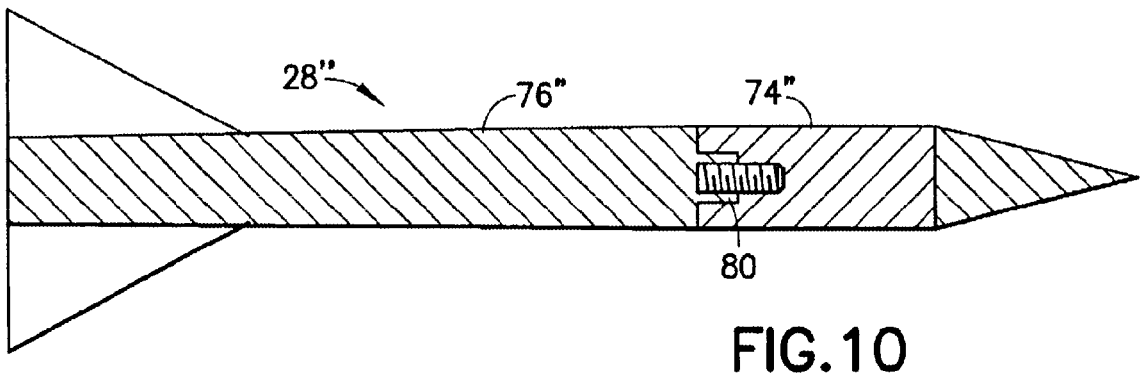
FIG. 10 is a cross-sectional view of a second alternate penetrator.

Another way to extend the clearance interval is to provide the second section 76 with a smaller characteristic diameter than the first section 74. FIG. 9 shows one such penetrator 28' having first and second sections 74' and 76' respectively. The first and second sections may each have varying diameters along their respective lengths. For example, as shown in FIG. 10, a second alternate penetrator 28" includes first and second sections 74" and 76". The presence of a relatively large diameter portion of the second section 76" proximate its fore end and tapering toward its aft end is advantageous to extend the clearance interval. This is because such a profile allows the side of the second section to be in very close proximity but not in contact with the hole perimeter 92 as the second section passes through the hole 90. However, if the second section 76" is relatively wide at its fore end, this will tend to disperse contact forces between the second section and the basal armor and thereby reduce penetration. In this regard, the presence of the reduced diameter portion 80 may bypass this effect by concentrating the impact forces over a correspondingly reduced area.

Figure 11:
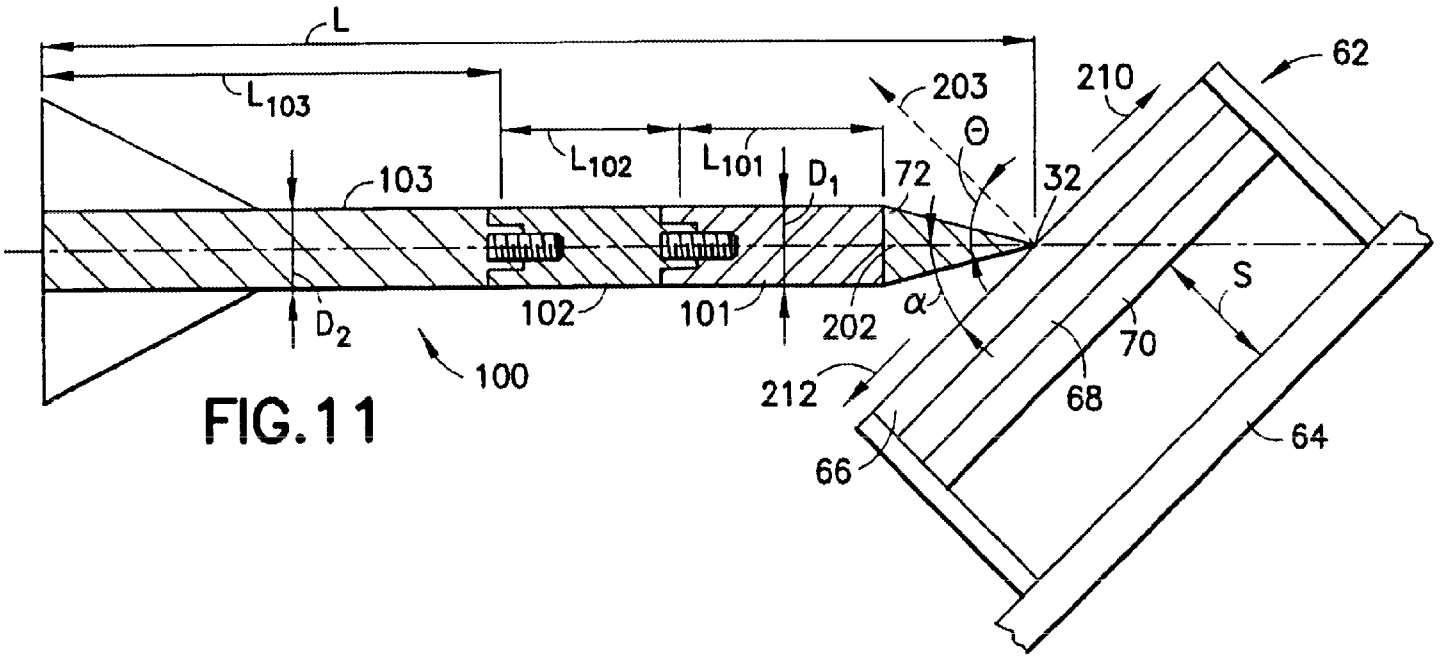
FIG. 11 is a cross-sectional view of a third alternate penetrator.
Figure 12:
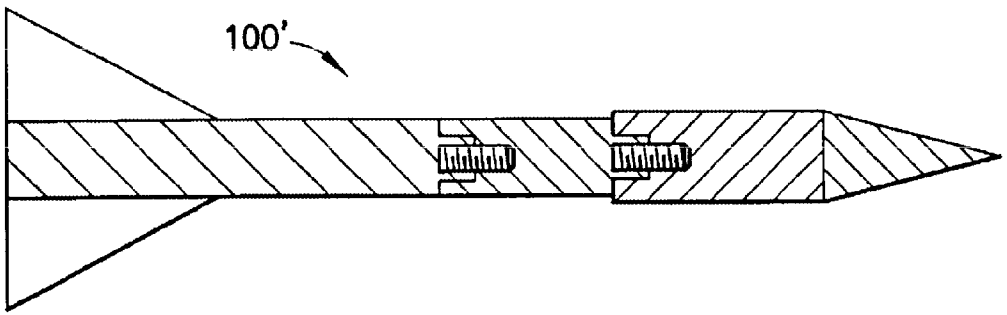
FIG. 12 is a cross-sectional view of a fourth alternate penetrator.
Figure 13:
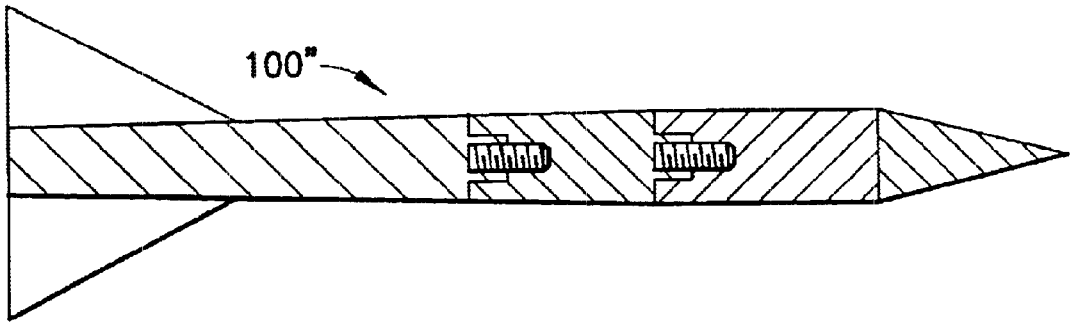
FIG. 13 is a cross-sectional view of a fifth alternate penetrator.
Figure 14:
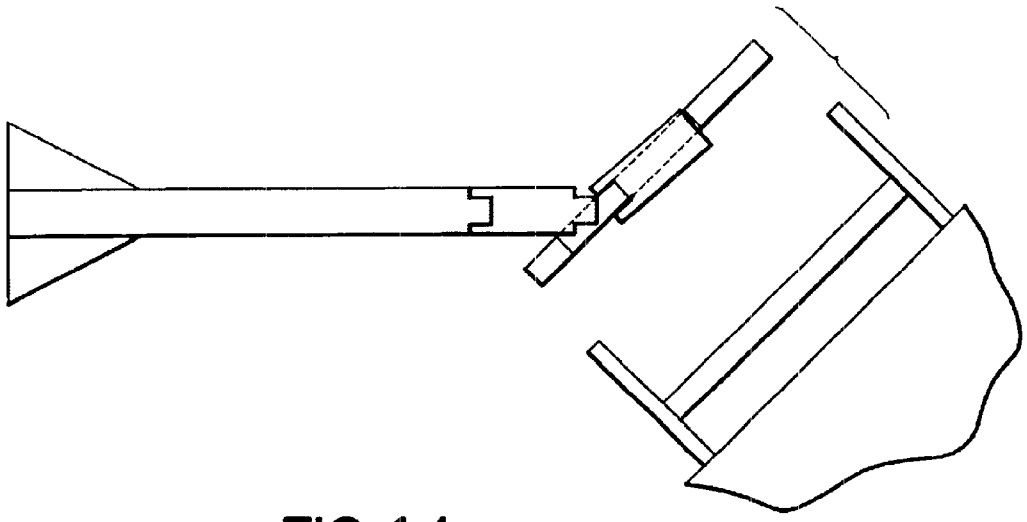
FIGS. 14 and 15 are semi-schematic views showing stages of interaction between the penetrator of FIG. 11 and vehicle armor.
Figure 15:
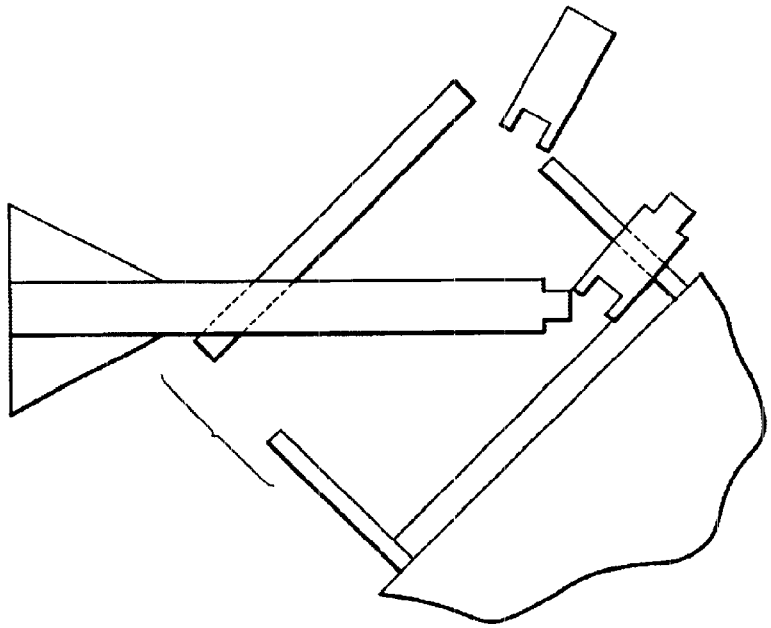

Another alternate penetrator 100 is shown in FIG. 11. Such a penetrator may be formed as a "drop-in" replacement for the penetrator 28 of the saboted projectile 26. The fins and ballistic tip may be similar to those of the penetrator 28. The penetrator 100 may have first, second, and third penetrator sections 101, 102 and 103. Each of the three sections 101–103 is formed of an ultradense material. The first section 101, at its fore end, carries the ballistic tip or nose. At its aft end, the first section is frangibly coupled to the fore end of the second section 102 by interfitting features which may be similar to those coupling the first and second sections 74 and 76 of the penetrator 28. At its aft end, the second section 102 is frangibly coupled to the fore end of the third section 103 by similar interfitting features. Dimensionally, the first section 101 may be similar to or the same as the first section 74 of the penetrator 28. In such a case, the second and third sections 102 and 103, combined, may have similar dimensions to the second section 76 of the penetrator 28. By way of example, the combined length $L_{101}$ and $L_{102}$ of the first and second sections 101 and 102 may be approximately 25–30% of the overall length $L_{101}+L_{102}+L_{103}$ of the three assembled sections 101–103. The length $L_{101}$ may still be the exemplary approximately 14% of such total length. While the penetrator 100 represents a three-piece modification of the basic two-piece configuration of the penetrator 28, FIGS. 12 and 13 show alternate penetrators 100' and 100" which represent similar modifications of the penetrators 28' and 28". In such a three-sectioned penetrator 100, both the second and third sections 102 and 103 are preferably performed of depleted uranium or such other material as may be chosen to produce a relatively deep yet narrow perforation. In such a configuration, the first section preferably still achieves its function of producing a relatively wide hole in the face plate. Deformation of the second section and its separation from the third section preferably further allow the third section to maintain a more normal relation to the basal armor. FIGS. 14 and 15 illustrate two sequential stages in this process.

Figure 16:
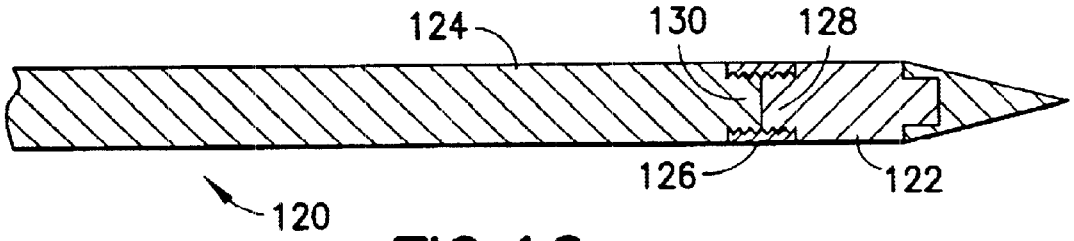
FIG. 16 is a cross-sectional view of a sixth alternate penetrator.

FIG. 16 shows an alternate penetrator 120 which may be otherwise similar to the penetrator 28 of FIG. 3 except as to the form of the frangible coupling between first and second penetrator sections 122 and 124. A tubular internally-threaded collar or sleeve 126 secures abutting externally-threaded reduced-diameter rear and fore portions 128 and 130 of the first and second penetrator sections, respectively. Other coupling configurations may alternatively be used. An important factor is that the coupling have sufficient strength to maintain engagement between the sections during expulsion from the weapon and flight to the target but not be so robust that it transfers sufficient force to induce bending of the aft portion(s) upon target impact of the fore portion(s). Various aspects of engagement forces and torques may be borne in disproportionate amounts by different portions of the coupling. By way of example, in the threaded stud embodiment of FIG. 3, the threaded stud provides substantially all the tensile strength to transmit aerodynamic drag forces from the fins on the second section to the first section to prevent longitudinal disengagement. The aft end of the first penetrator section 74 at the pocket 82 has sufficient strength to resist torsional forces such as associated with projectile yaw and pitch upon launch. However, it is weak (frangible) enough to quickly break upon impact without transmitting substantial force to the second section.

One or more embodiments of the present invention have been described. Nevertheless, it will be understood that various modifications may be made without departing from the spirit and scope of the invention. For example, the multi-piece penetrator may be formed as a drop-in replacement for any of a number of conventional substantially monolithic penetrators used in a variety of weapons. Accordingly, other embodiments are within the scope of the following claims.

What is claimed is:

1. An ammunition system for use with a weapon having a chamber and a barrel extending from the chamber to a muzzle, the system comprising:

a subcaliber kinetic energy penetrator having a penetrator mass and extending along a longitudinal axis and comprising: an elongate body having fore and aft ends; and a plurality of stabilizing fins projecting from the body; and a discardable segmented sabot comprising: a plurality of longitudinal segments, having an assembled configuration surrounding the penetrator and secured thereto against relative longitudinal movement, the assembled segments defining at least one flange projecting radially outward and effective to allow the sabot and penetrator to be propelled forward through the barrel by the expansion of gas behind the at least one flange, wherein the body comprises:

a first portion of the body having a first mass of between about 9% and 15% of the penetrator mass; and a second portion of the body having a second mass greater than the first mass and positioned aft of the first portion of the body;

a coupling frangibly securing the first portion of the body to the second portion of the body via interfitting features and a threaded stud;

the interfitting features comprising a reduced diameter portion of the second portion of the body, the reduced diameter portion of the second portion of the body adjacent the fore end thereof, a mating cylindrical bore having a base and formed in the aft end of the first portion of the body and in receipt of the reduced diameter portion of the second portion of the body;

wherein the threaded stud extends centrally and longitudinally from within the reduced diameter portion through the cylindrical bore and the base and into the first portion of the body; and whereby the coupling maintains the first portion of the body secured to the second portion of the body until a torque on the body transverse to the longitudinal axis exceeds a threshold, said threshold being selected to permit deformation of the first portion of the body when the body impacts an armor face plate at an oblique relation while substantially confining such deformation to said first portion of the body;

wherein the first portion of the body consists essentially of material selected from the group consisting of tungsten, tungsten-based alloys, and tungsten-based composites; and wherein the second portion of the body consists essentially of uranium, uranium-based alloys or uranium-based composites.

2. The ammunition system of claim 1 wherein the penetrator mass is between about 4.0 kg and 4.6 kg.

3. The ammunition system of claim 1 wherein the first and second portions of the body each have density greater than about 17.0 g/cm$^3$.

4. The ammunition system of 1 wherein the first portion of the body consists essentially of a first monolithic piece and the second portion consists essentially of a second monolithic piece.

5. The ammunition system of claim 1 wherein the first portion of the body has a first median diameter and the second portion of the body has a second median diameter less than the first median diameter.

6. The ammunition system of claim 1 wherein the first portion of the body has a first median diameter and a first maximum diameter and the second portion of the body has a second median diameter less than the first maximum diameter.

7. The ammunition system of claim 1 wherein the first portion of the body has a first length and second portion of the body has a second length which is between about 400% and 700% of the first length.

8. The ammunition system of claim 1 further comprising an aerodynamic tip extending from a fore end of the first portion of the body to the fore end of the body, such aerodynamic tip having a density less than half of a density of said first portion of the body.

9. The ammunition system of claim 1 wherein the second portion of the body comprises:

a substantially monolithic first subportion of the second portion of the body having a third mass which is less than half of the second mass of the second portion of the body; and a substantially monolithic second subportion of the second portion of the body positioned aft of the first subportion of the body and frangibly coupled thereto by another frangible coupling so as to maintain the first subportion of the second portion of the body secured to the second subportion of the second portion of the body until a torque on the body transverse to the longitudinal axis exceeds another threshold and wherein the another threshold is selected so that the another frangible coupling between the first and second subportions of the second portion of the body ruptures after the frangible coupling between the first portion and the second portion of the body.

10. The ammunition system of claim 9 wherein both the substantially monolithic first subportion of the second portion of the body and substantially monolithic second subportion of the second portion of the body are formed of depleted uranium.

11. The ammunition system of claim 9 wherein both the substantially monolithic first subportion of the second portion of the body and substantially monolithic second subportion of the second portion of the body are formed of a material that produces a relatively deep yet narrow perforation.

12. The ammunition system of claim 9 wherein:

the another frangible coupling securing the first subportion of the second portion of the body and the second subportion of the second portion of the body via additional interfitting features and an additional threaded stud;

the additional interfitting features comprising a reduced diameter portion of the second subportion of the second portion of the body, the reduced diameter portion of the second subportion of the second portion of the body adjacent the fore end thereof, a another mating cylindrical bore having a base and formed in the aft end of the first subportion of the second portion of the body and in receipt of the reduced diameter portion of the second subportion of the second portion of the body;

wherein the additional threaded stud extends centrally and longitudinally from within the reduced diameter potion of the second subportion of the second portion of the body through the cylindrical bore and base and into the first subportion of the body;

whereby the another coupling maintains the first subportion secured to the second subportion until a torque on the second portion of the body transverse to the longitudinal axis exceeds the another threshold.

13. The ammunition system of claim 1 wherein the first portion of the body has a density substantially the same as a density of the second portion of the body.

14. An ammunition system comprising:

a subcaliber kinetic energy penetrator comprising: an elongate body having fore and aft ends; and a plurality of stabilizing fins projecting from the body; and a discardable sabot having an assembled configuration surrounding the penetrator and secured thereto against relative longitudinal movement, wherein the body extends along a projectile longitudinal axis and comprises:

a first portion of the body having a first mass of about at least 9% to 15% of a penetrator mass and consisting primarily of a single piece of a tungsten-based material;

a second portion of the body having a second mass about at least half of the penetrator mass and positioned aft of the first portion of the body and consisting primarily of a single piece of a uranium-based material;

and a coupling frangibly securing the first portion of the body to the second portion of the body via interfitting features and a threaded stud;

the interfitting features comprising a reduced diameter portion of the second portion of the body, the reduced diameter portion of the second portion of the body adjacent the fore end thereof, a mating cylindrical bore having a base and formed in the aft end of the first portion of the body and in receipt of the reduced diameter portion of the second portion of the body;

wherein the threaded stud extends centrally and longitudinally from within the reduced diameter portion through the cylindrical bore and the base and into the first portion; and whereby the coupling is frangible so as to maintain the first portion of the body secured to the second portion of the body until a torque on the body transverse to the longitudinal axis exceeds a threshold.

15. The ammunition system of claim 14 wherein the first portion of the body has a density substantially the same as a density of the second portion of the body.

16. An ammunition system for use with a weapon having a chamber and a barrel extending from the chamber to a muzzle, the system comprising:

a subcaliber kinetic energy penetrator having a penetrator mass and extending along a longitudinal axis and comprising: an elongate body having fore and aft ends; and a plurality of stabilizing fins projecting from the body; and a discardable segmented sabot comprising: a plurality of longitudinal segments, having an assembled configuration surrounding the penetrator and secured thereto against relative longitudinal movement, the assembled segments defining at least one flange projecting radially outward and effective to allow the sabot and penetrator to be propelled forward through the barrel by the expansion of gas behind the at least one flange, wherein the body has:

a first portion consisting essentially of a first material and having a first mass of between about 9% and 15% of the penetrator mass; and wherein the first portion consists essentially of material selected from the group consisting of tungsten, tungsten-based alloys, and tungsten-based composites a second portion consisting essentially of a of uranium, uranium-based alloys or uranium-based composites and having a second mass greater than the first mass and positioned aft of the first portion and frangibly coupled to the first portion, securing the first portion to the second portion via interfitting features and a threaded stud;

the interfitting features comprising a reduced diameter portion of the second portion of the body, the reduced diameter portion of the second portion of the body adjacent the fore end thereof, a mating cylindrical bore having a base and formed in the aft end of the first portion of the body and in receipt of the reduced diameter portion of the second portion of the body;

wherein the threaded stud extends centrally and longitudinally from within the reduced diameter portion through the cylindrical bore and the base and into the first portion of the body; and whereby the coupling is frangible so as to maintain the first portion of the body secured to the second portion of the body until a torque on the body transverse to the longitudinal axis exceeds a threshold and wherein shear properties of the first and second materials are such that with substantially identical mass and cross-sectional area projectiles of said first and second materials, the projectile of said first material would produce a larger diameter hole in a given armor plate through which both projectiles are capable of passing, while the projectile of said second material would penetrate plates at thicknesses which the projectile of said first material can not penetrate.

17. The ammunition system of claim 16, wherein the first portion of the body has a density substantially the same as a density of the second portion of the body.

18. An ammunition system for use with a weapon having a chamber and a barrel extending from the chamber to a muzzle, the system comprising:

a subcaliber kinetic energy penetrator having a penetrator mass and extending along a longitudinal axis and comprising: an elongate body having fore and aft ends; and a plurality of stabilizing fins projecting from the body; and a discardable segmented sabot comprising: a plurality of longitudinal segments, having an assembled configuration surrounding the penetrator and secured thereto against relative longitudinal movement, the assembled segments defining at least one flange projecting radially outward and effective to allow the sabot and penetrator to be propelled forward through the barrel by the expansion of gas behind the at least one flange, wherein the body has a second portion positioned aft of a first portion and wherein:

the first portion of the body consisting essentially of a first monolithic piece and having a first mass of between about 9% and 15% of the penetrator mass and wherein the first portion of the body consists essentially of material selected from the group consisting of tungsten, tungsten-based alloys, and tungsten-based composites; and the second portion of the body consisting essentially of a second monolithic piece and having a second mass forming substantially the rest of the penetrator mass and wherein the second portion of the body consists essentially of uranium, uranium-based alloys, or uranium-based composites;

a coupling frangibly securing the first portion of the body to the second portion of the body via interfitting features and a threaded stud;

the interfitting features comprising a reduced diameter portion of the second portion of the body, the reduced diameter portion of the second portion of the body adjacent the fore end thereof, a mating cylindrical bore having a base and formed in the aft end of the first portion of the body and in receipt of the reduced diameter portion of the second portion of the body;

wherein the threaded stud extends centrally and longitudinally from within the reduced diameter portion through the cylindrical bore and the base and into the first portion of the body; and whereby the coupling is frangible so as to maintain the first portion of the body secured to the second portion of the body until a torque on the body transverse to the longitudinal axis exceeds a threshold.

19. The ammunition system of claim 18 wherein the first portion of the body has a density substantially the same as a density of the second portion of the body.

20. An ammunition system for use with a weapon having a chamber and a barrel extending from the chamber to a muzzle, the system comprising:

a subcaliber kinetic energy penetrator having a penetrator mass and extending along a longitudinal axis and comprising: an elongate body having fore and aft ends; and a plurality of stabilizing fins projecting from the body; and a discardable segmented sabot comprising: a plurality of longitudinal segments, having an assembled configuration surrounding the penetrator and secured thereto against relative longitudinal movement, the assembled segments defining at least one flange projecting radially outward and effective to allow the sabot and penetrator to be propelled forward through the barrel by the expansion of gas behind the at least one flange, wherein the body has:

a first portion consisting essentially of material selected from the group consisting of tungsten, tungsten-based alloys, and tungsten-based composites and having a first mass of between about 9% and 15% of the penetrator mass; and a second portion consisting essentially of material selected from the group consisting of uranium, uranium-based alloys, and uranium-based composites and having a second mass forming substantially the rest of the penetrator mass and positioned aft of the first portion of the body;

a coupling frangibly securing the first portion of the body to the second portion of the body via interfitting features and a threaded stud;

the interfitting features comprising a reduced diameter portion of the second portion of the body, the reduced diameter portion of the second portion of the body adjacent the fore end thereof, a mating cylindrical bore having a base and formed in the aft end of the first portion of the body and in receipt of the reduced diameter portion of the second portion of the body;

wherein the threaded stud extends centrally and longitudinally from within the reduced diameter portion through the cylindrical bore and the base and into the first portion of the body; and whereby the coupling is frangible so as to maintain the first portion of the body secured to the second portion of the body until a torque on the body transverse to the longitudinal axis exceeds a threshold.

21. The ammunition system of claim 20 wherein the first portion of the body has a density substantially the same as a density of the second portion of the body.

* * * * *